US006535612B1

(12) United States Patent
Croft, III et al.

(10) Patent No.: US 6,535,612 B1
(45) **Date of Patent: *Mar. 18, 2003**

(54) ELECTROACOUSTIC TRANSDUCER WITH DIAPHRAGM SECURING STRUCTURE AND METHOD

(75) Inventors: James J. Croft, III, Poway, CA (US); Terry J. Conrad, San Diego, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/375,145

(22) Filed: Aug. 16, 1999

Related U.S. Application Data

(63) Continuation-in-part of application No. 09/207,314, filed on Dec. 7, 1998, now Pat. No. 6,201,874.

(51) Int. Cl.[7] ..... H04R 35/00

(52) U.S. Cl. ..... 381/191; 381/184; 381/423; 381/399; 381/398; 381/395

(58) Field of Search ..... 381/184, 395, 381/191, 398, 399, 402, 423

(56) References Cited

U.S. PATENT DOCUMENTS

| | | | | |
|---|---|---|---|---|
| 1,809,754 | A | * | 6/1931 | Steedle |
| 3,859,477 | A | * | 1/1975 | Skvor |
| 4,006,317 | A | * | 2/1977 | Freeman |
| 4,041,446 | A | * | 8/1977 | Liebermann |
| 5,054,081 | A | | 10/1991 | West |
| 5,206,557 | A | | 4/1993 | Bobbio |
| 6,393,129 | B1 | * | 5/2002 | Conrad |

* cited by examiner

*Primary Examiner*—Curtis Kuntz
*Assistant Examiner*—Dionne Harvey

(74) *Attorney, Agent, or Firm*—Thorpe North & Western L.L.P.

(57) ABSTRACT

An electroacoustic transducer which has at least one stator member with an operating surface and a suspended emitter diaphragm spaced from the operating surface of the stator member to enable the diaphragm to oscillate in response to an applied signal voltage. The diaphragm has increased stiffness in a direction along the diaphragm and within the emitter section to enable the emitter diaphragm to oscillate without applying tension in the direction of stiffness. A clamp member secures the diaphragm to maintain the diaphragm in a fixed position relative to the stator to minimize distortion. The clamp member is positioned to define at least two isolated emitter sections for enhancing the frequency response of the transducer.

A method is also provided for generating audio output from an electroacoustic transducer. A stator member with an operating surface is positioned adjacent to an emitter diaphragm, which is suspended and spaced a sufficient distance from the operating surface of the stator member to enable diaphragm oscillation in an emitter section of the diaphragm in response to an applied signal voltage. The diaphragm is configured with increased stiffness longitudinally along the diaphragm and within the emitter section to enable the emitter diaphragm to oscillate without applying tension in the direction of stiffness. A clamp is positioned between the diaphragm and the operating surface of the stator member to maintain the diaphragm in a fixed position relative to the stator. Emitter sections on the diaphragm are established by the clamp to provide complementary resonant frequencies, to enhance the frequency response of the transducer.

70 Claims, 11 Drawing Sheets

ELECTROACOUSTIC TRANSDUCER WITH DIAPHRAGM SECURING STRUCTURE AND METHOD

This application is a continuation-in-part of U.S. Ser. No. 09/207,314, now U.S. Pat. No. 6,201,874 entitled "Electrostatic Transducer with Nonplanar Configured Diaphragm" filed on Dec. 7, 1998.

BACKGROUND OF THE INVENTION

1. Field of the Invention

This invention relates to charged capacitive transducers, and in particular to diaphragm configurations in electroacoustic speakers, where a diaphragm is directionally stiffened and spaced from stator elements by a securing structure.

2. Prior Art

Electrostatic loudspeakers are relatively simple in theory and structure. Basically, the components consist of (i) one or two rigid stators to which an audio voltage is applied and (ii) a flexible emitter diaphragm between or adjacent to the stators, which is usually biased with a high voltage for optimal performance. Typically, a planar diaphragm is stretched between the opposing stators and slightly spaced therefrom to provide a small air gap in which the diaphragm oscillates. This structure is sometimes called a push-pull transducer, because one stator is pushing while the other is pulling or releasing the diaphragm.

One of the advantages of the electrostatic loudspeaker is it has a diaphragm which is driven equally at all points of its surface, thereby providing a linear operation and minimizing breakup, harmonic distortion and phase differences. Because the diaphragm and stators can be very light and there is normally no magnet, as in electrodynamic speakers, electrostatic loudspeakers are typically very light for their size.

Electrostatic loudspeakers have been on the market since the late 1940s, but have only had limited use and availability because of technical problems. Some of the difficulties include the competing requirements for diaphragm tension, resonant frequency, bias voltage and diaphragm stability. Prior art electrostatic speakers also require a large surface area to produce low frequencies, and tend to develop undesirable levels of directivity and capacitive impedance at higher frequencies.

Tensioning of the diaphragm is a particularly challenging problem. Difficulties are encountered in applying and maintaining precise tension on the diaphragm to avoid distortion while obtaining an optimal range of frequency response. If the diaphragm is slightly too loose, distortion becomes apparent. If tension on the diaphragm is too tight, the low frequencies may be muted or lost. Thus, frequency response over a wide spectrum can be difficult.

Another key problem is that a speaker typically starts to fall off in amplitude at six decibels per octave with decreasing audio frequencies. The resonance frequency is usually exhibited after a substantial part of where the decibel drop-off occurs. At the resonant frequency of the transducer, a substantial amplitude peak is encountered followed by an even more severe amplitude drop-off of twelve additional decibels per octave. These amplitude drops make it difficult to maintain a consistent volume at lower frequencies. Some designers of electrostatic speakers have addressed the frequency range problem by employing different sized drivers, which adds to the cost, size and complexity of the speakers. Others have divided the diaphragm area into more easily handled sub-panels, which each have their own frequency response characteristics. U.S. Pat. No. 5,054,081 to West teaches an electrostatic transducer in which a number of stretched diaphragm sections are constructed and arranged so that each section has a resonant frequency that differs from that of the other diaphragm sections. However, the sensitivity problems associated with requiring precise tension on the diaphragm are still present.

What is needed is an electrostatic transducer that does not demand precise tensioning in order to obtain a wide frequency response. Moreover, an electrostatic transducer is needed that does not encounter significant variations in amplitude because of decibel drop-off and resonant frequency amplitude spikes. Further, An electrostatic transducer is needed that is lightweight, inexpensive and simple in construction. In addition, an electrostatic speaker that can be curved to provide desired directional characteristics would be advantageous.

OBJECTS AND SUMMARY OF THE INVENTION

It is an object of the present invention to provide an electroacoustic speaker with a broad band, high quality audio output.

It is a further object of this invention to provide an electrostatic speaker that is mechanically superior to prior art electrostatic speaker transducers.

It is also an object of the present invention to provide sufficient stiffness to the diaphragm to enable operable oscillations of the diaphragm, without requiring the diaphragm to be under tension.

It is another object of the present invention to provide a way to compensate for the amplitude drop-off, the resonant frequency spike of the electrostatic transducer, and to enhance the frequency response of the speaker.

It is yet another object to provide an electrostatic speaker which is light-weight, inexpensive and simple to construct.

In one preferred embodiment, an electroacoustic transducer includes at least one stator member having an operating surface positioned adjacent to an emitter diaphragm. The diaphragm is suspended and spaced a sufficient distance from the operating surface of the stator member to enable diaphragm oscillation in response to an applied signal voltage without incurring contact from the operating surface of the stator member. The diaphragm has at least one increased stiffness orientation which provides a directional stiffness along the diaphragm and within the emitter section to enable the emitter diaphragm to oscillate without applying tension in the direction of stiffness. A securing structure or clamp is applied to the diaphragm and the operating surface of the stator member to maintain the diaphragm in a fixed position relative to the stator.

In another preferred embodiment, a method is provided for generating audio output from an electroacoustic transducer. The method includes the step of positioning at least one stator member having an operating surface adjacent an emitter diaphragm. The second step is suspending an emitter diaphragm adjacent to and spaced a sufficient distance from the operating surface of the stator member. This enables diaphragm oscillation in an emitter section of the diaphragm in response to an applied signal voltage without incurring interfering contact with the operating surface of the stator member. The next step is configuring the diaphragm with at least one increased stiffness orientation to provide a primary directional stiffness along the diaphragm and within the emitter section to enable the emitter diaphragm to operably oscillate in the absence of tension applied along the stiffness orientation. The final step is positioning a securing structure between the diaphragm and the operating surface of the stator member to secure the diaphragm in a fixed position relative to the stator.

Other objects and features of the present invention will be apparent from the following detailed description, taken in combination with the following drawings.

DETAILED DESCRIPTION OF THE PREFERRED EMBODIMENTS

Figure 1:
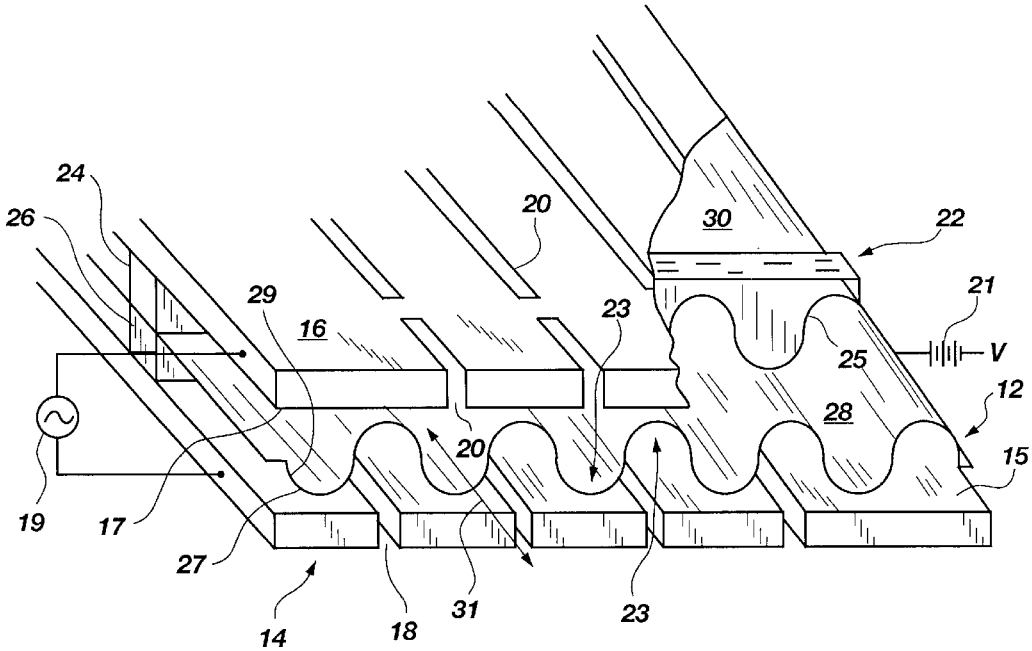
FIG. 1 is a partially-cutaway perspective view of an electroacoustic transducer with a generally sinusoidal diaphragm disposed between and spaced apart from the opposing stators by a clamp member.
Figure 2:
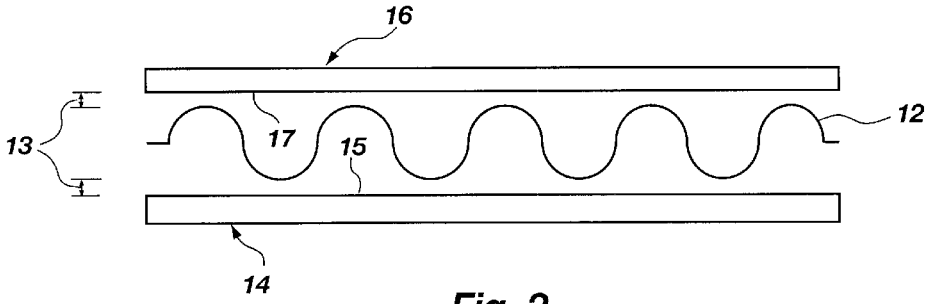
FIG. 2 is a front orthogonal view of the embodiment shown in the FIG. 1.

Referring now to FIGS. 1 and 2, an electrostatic transducer is shown having a substantially sinusoidally-shaped diaphragm 12 spaced between and apart from a pair of opposing stators 14 and 16. Slots or openings 18 and 20 in stators 14 and 16, respectively, are disposed adjacent to a valley or trough of the diaphragm to provide acoustic energy outlets and transparency for the audio output of the system.

The sinusoidal shape of diaphragm 12 provides alternating peaks 27 and valleys 29 extending along the longitudinal dimension of the diaphragm, and creates an increased stiffness in the longitudinal direction 31 of the diaphragm. This stiffness enables the diaphragm to oscillate sufficiently to provide acoustic tones without any tension applied in the longitudinal dimension. This stiffness is referred to here as an "increased stiffness orientation" which corresponds to the directional stiffness of the channels 23 or other stiffening means.

A clamp 22 is disposed at an intermediate position along the stiffened longitudinal dimension of the diaphragm. The clamp 22 comprises opposing clamp members 24 and 26 which extend transversely across the diaphragm 16. This clamp 22 may effectively be composed of any rigid material, preferably having insulating qualities, to isolate separate emitter sections 28 and 30 in the diaphragm 12, and to provide certain desired frequency responses, as discussed later. The cutaway portion of FIG. 1 shows a clamp member 24 with an inner surface 25 which substantially conforms to the sinusoidal shape of diaphragm 12. A similar sinusoidal clamp configuration may be seen in FIG. 6.

It should be mentioned that any conductive material typically used for conventional electrostatic transducers may be used for the stators of the present invention, including metals, doped plastics and nonconductive substrates with a conductive coating. The stators 14 and 16 are preferably configured to provide uniform charge dispersion and rigid support, as is well known to those skilled in the art. The diaphragm 12 is preferably flexible and may be constructed with a conductive layer on the outside. However, a double-sided polyester-metal-polyester film is preferably used to stop arcing between the diaphragm and the stators. Other compositions for emitter films which are well known, may also be used for the diaphragm. Preferably the diaphragm is pre-molded in its sinusoidal shape and is flexible so it may resume its shape after temporary deformation.

As best seen in FIG. 2, diaphragm 12 is spaced a small distance 13 from the operating surfaces 15 and 17 of stators 14 and 16, respectively, to enable the diaphragm to oscillate in response to an applied voltage without contacting the respective operating surfaces. Spacing the diaphragm from the operating surface avoids interfering contact and distortion. As defined here, "interfering contact" means diaphragm contact with the stator such as slapping or distortion producing contact. In contrast, the diaphragm can have some light contact with the stator or contact with a cushioned surface between the stator and the diaphragm which will not create distortion. During operation, an audio signal 19 is applied across stators 14 and 16, and diaphragm 12 is biased with a high voltage 21 in a conventional manner. Alternately, an audio signal 19 may be applied to the diaphragm 12 and the bias voltage applied across the stators 14 and 16 instead.

Figure 3:
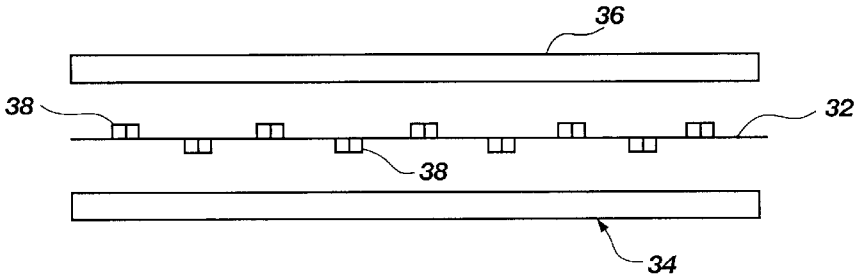
FIG. 3 is a front view of an electroacoustic transducer with a diaphragm and stiffening strips attached to the diaphragm.

Although a sinusoidal shape is shown for the diaphragm 12 in the embodiment of FIGS. 1 and 2, it should be understood that other non-planar shapes, such as a rectified half wave or a random array of peaks and valleys, would be suitable for the present invention. It is also important that the selected shape provides an increased stiffness along the longitudinal dimension of the diaphragm. In addition, the diaphragm of the present invention may be a substantially planar diaphragm 32 spaced between the stators 34 and 36, as shown in FIG. 3. Stiffening strips 38 are then attached to the diaphragm 32 and extend longitudinally along it. Alternately, in place of stiffening strips 38, a planar diaphragm 32 may have strips of stiffer, less flexible composition integrated into the diaphragm. It should also be realized that other methods known in the art may be used to longitudinally stiffen a diaphragm and produce operable acoustical oscillations without the application of tension in the longitudinal dimension.

Figure 4:
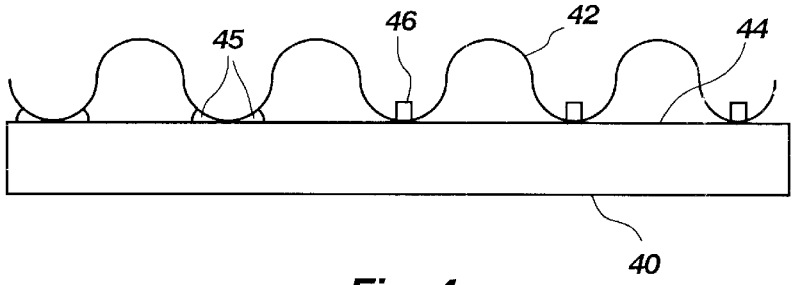
FIG. 4 is a partial front view of an electroacoustic transducer having a single clamp member in contact with a non-planar diaphragm.
Figure 5:
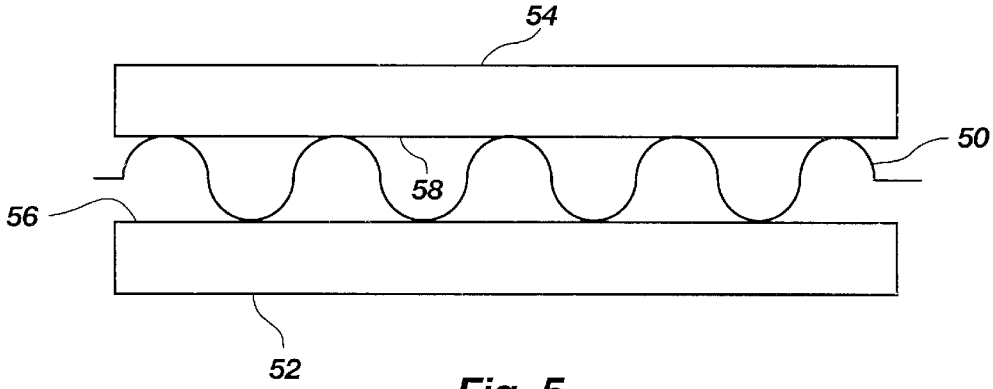
FIG. 5 is a partial front view of an electroacoustic transducer showing a pair of clamp members touching both sides of the diaphragm.

Referring now to FIGS. 4 through 9, various embodiments of clamping members for securing the diaphragm are shown. In FIG. 4, a clamping member 40 extends adjacent to a flexible non-planar diaphragm 42 so that its inner surface 44 is touching or is bonded to the peaks of the diaphragm. A suitable coupling means, such as an adhesive 45 or a clip 46, is applied to secure the diaphragm 42 to the clamping member 40. In FIG. 5, a diaphragm 50 is arranged between opposing clamping members 52 and 54, and secured to their inner clamping surfaces 56 and 58 at the peaks of the non-planar diaphragm 50. It should be mentioned that the diaphragm 50 may be secured to members 52 and 54 by an adhesive or other conventional securing means.

Figure 6:
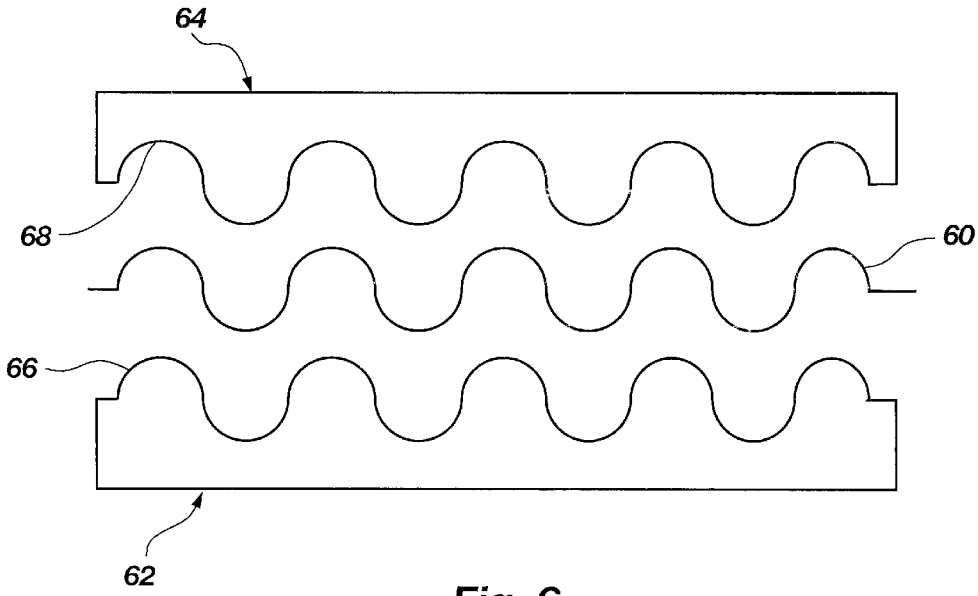
FIG. 6 is another partial front view of an electroacoustic transducer showing a pair of clamp members to secure a non-planar diaphragm and having inner surfaces conforming to the shape of the non-planar diaphragm.
Figure 7:
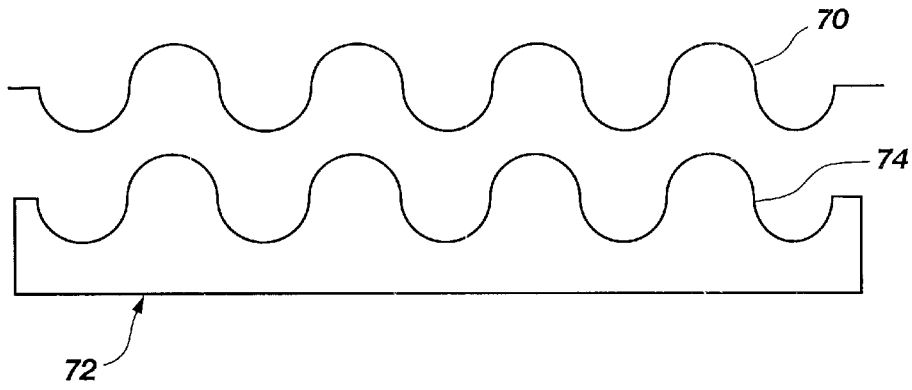
FIG. 7 is partial front view of an electroacoustic transducer, showing a single clamp member to secure a non-planar diaphragm and having an inner surface conforming to the shape of a non-planar diaphragm.

As shown in FIG. 6, the inner surfaces 66 and 68 of clamp members 62 and 64 may be configured in a sinusoidal shape corresponding to the diaphragm shape 60 in order to firmly clamp down on the diaphragm 60 and achieve substantial isolation of the emitter section 9 (not shown) without crushing the non-planar shape of the diaphragm 60. This clamp configuration is essentially the same as shown in FIG. 1. Clamp members 62 and 64 are shown spaced apart from diaphragm 60 only for illustrative purposes. In use, clamp members 62 and 64 are firmly clamped on diaphragm 60. Likewise, in FIG. 7, a single clamp member 72 also has an inner surface 74 shaped to conform to the shape of the diaphragm 70. Again, the diaphragm 70 is secured to the clamp member 72 by an adhesive or other conventional means. It should also be apparent based on this disclosure that the clamping elements may be some other shape configuration which matches the diaphragm, such as sawtooth shaped, rectified sine wave shaped, or some other similar shape. In an alternative embodiment of the invention, the clamp members may be configured to create some tension along the stiffness orientation, as long as the tension does not interfere with the diaphragm oscillation. Of course, tensioning the diaphragm is not a requirement but some tension can be used.

Figure 8:
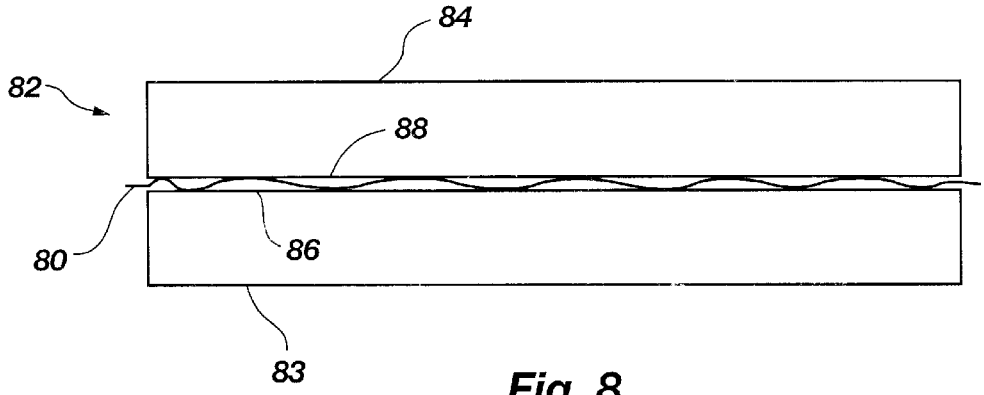
FIG. 8 shows a front view of an electroacoustic transducer with a non-planar diaphragm deformed substantially flat and secured between the inner planar surfaces of a pair of clamp members.
Figure 9:
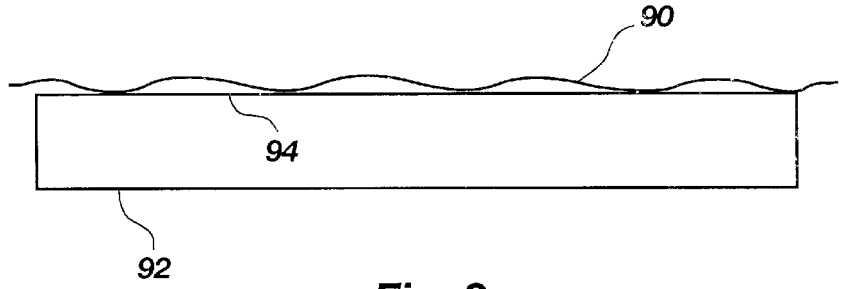
FIG. 9 is partial front view of an electroacoustic transducer, showing a non-planar diaphragm deformed substantially flat and secured to an inner planar surface of a clamp member.

As shown in FIG. 8, a clamp 82 with opposing clamp members 83 and 84 has opposing inner planar surfaces 86 and 88 which are clamped down tightly against a non-planar diaphragm 80 crushing the diaphragm shape substantially flat between surfaces 86 and 88. Preferably such shape crushing only occurs in the immediate inner surfaces of the clamp members 83 and 84, and the diaphragm 80 maintains its non-planar shape and stiffness orientation in the emitter sections on either side of the clamp members. The diaphragm 80 is preferably heat formed so as to resume its non-planar shape when the clamping pressure is removed. Although the embodiment shown in FIG. 9 is less effective, a single clamp member 92 with a planar surface 94 may have a non-planar diaphragm 90 crushed substantially flat adjacent to the surface 94. The diaphragm 90 is also secured to the clamp member 92 by conventional means, such as adhesive.

Figure 10:
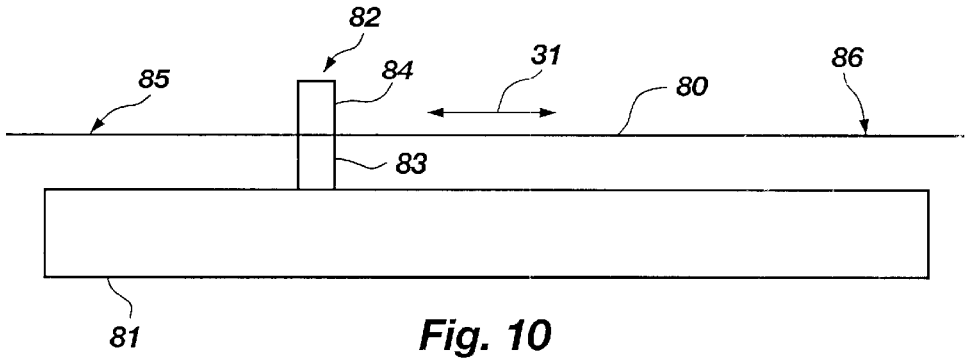
FIG. 10 shows a side view of the electroacoustic transducer of FIG. 1 with a clamp member supporting a diaphragm above the inner surface of a stator member.
Figure 11:
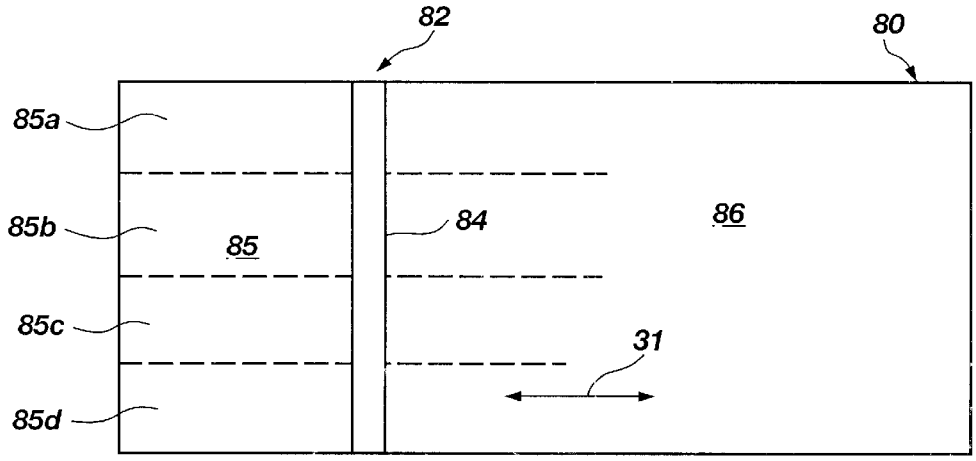
FIG. 11 is a top plan view of the electroacoustic transducer in FIG. 10 providing a clamp member disposed at an intermediate position along the diaphragm which extends transversely across the diaphragm.

Looking now at FIGS. 10 through 15, various configurations and positions of one or more clamps on the diaphragm of an electrostatic emitter are shown. The stiffness orientation is generally represented by arrow 31 in all the figures. FIGS. 10 and 11 provide side and top views, respectively, of the embodiment shown in FIG. 8, wherein clamp 82, consist of a pair of clamp members 83 and 84, secured to the diaphragm 80. As shown, clamp 82 is disposed on a stator 81 at an intermediate position along the longitudinal direction of stiffness 31 of diaphragm 80 which extends transverse to the direction of stiffness. This intermediate position of clamp 82 divides diaphragm 80 into two emitter sections 85 and 86, each isolated from the other. Each section has its own resonant frequency or frequencies, which are dependent on the shape and area of that section. In another embodiment, sections 85*a–d* could be made of alternating material with reduced flexibility for stiffness enhancement.

Figure 12:
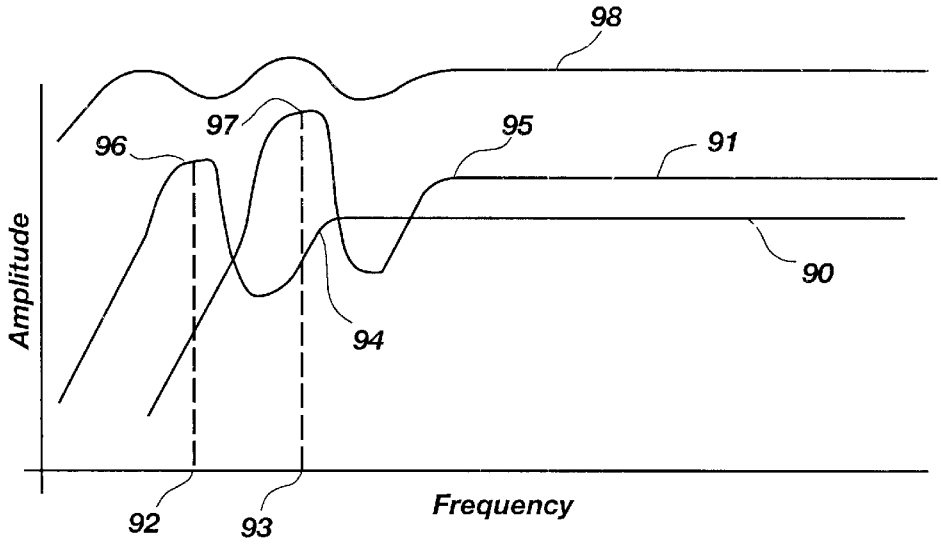
FIG. 12 is the frequency response graph of the emitter sections of the diaphragm in accordance with the embodiment of the invention shown in FIGS. 10 and 11.

An important advantage of this invention is that the disposition of clamp 82 has at least two effects. First, clamp 82 defines two distinct and isolated emitter sections to minimize undesirable vibrations and distortion generating oscillations. Second, clamp 82 establishes different-sized emitter sections, each supporting a different set of resonant frequencies. This structure tends to extend the effective frequency range of the transducer. FIG. 12 shows at least two different signals 90 and 91 having different resonant frequencies 92 and 93. These two signals have different points 94 and 95 in their frequency responses below which the amplitude of each signal drops off at a rate of six decibels per octave. Further, below points 94 and 95 the signals reach their resonant frequencies 92 and 93, resulting in amplitude peaks 96 and 97. Since the amplitude peaks 96 and 97 are at different frequencies, they tend to combine and at least partially offset their respective signal attenuations. More specifically, as shown in FIG. 12 the combined signal response 98 tends to drop off only slightly after point 95, because signal 90 has not yet reached its attenuation point 94. The combined signal remains approximately constant below point 94 because the amplitude drop of signal 90 is compensated by the peak 97 of signal 91 at its resonant frequency 93. Thereafter, as combined signal 98 begins to drop again, it is lifted by the amplitude boost 96 of signal 90 as it reaches its resonant frequency 92. The result is a combined frequency response which has a substantially enhanced signal, particularly in the lower frequency range.

Figure 13:
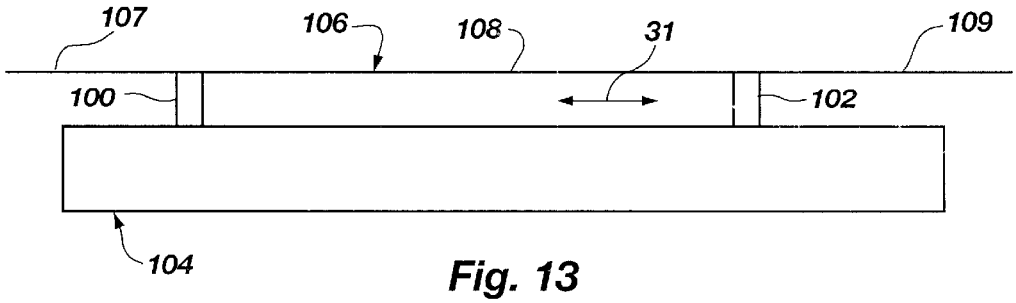
FIG. 13 is a side view of an electroacoustic transducer with two clamp spacers at intermediate positions near the front and back of an electroacoustic transducer, to suspend the diaphragm from the inner surface of a stator.
Figure 14:
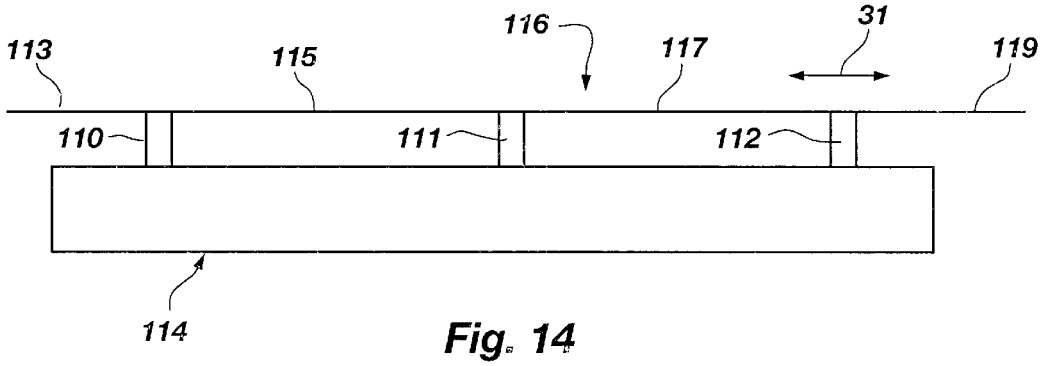
FIG. 14 is a side view of an electroacoustic transducer with three clamp spacers at intermediate positions along a direction of stiffness of the diaphragm.

In FIG. 13, a variation of the embodiment of FIGS. 10 and 11 is shown. Two clamps 100 and 102 are positioned on a stator 104 to secure a diaphragm 106 and form emitter sections 107, 108 and 109. Each of those sections has a different size and frequency response, which together provide an enhanced transducer frequency response. Similarly, in FIG. 14, three clamps 110, 111, and 112 are disposed on a stator 114 to secure a diaphragm 116 at three different positions. The clamp positions determine the size and shape of the four emitter sections 113, 115, 117, 119 on the diaphragm 116, thereby enabling the creation of a desired composite frequency response.

Figure 15:
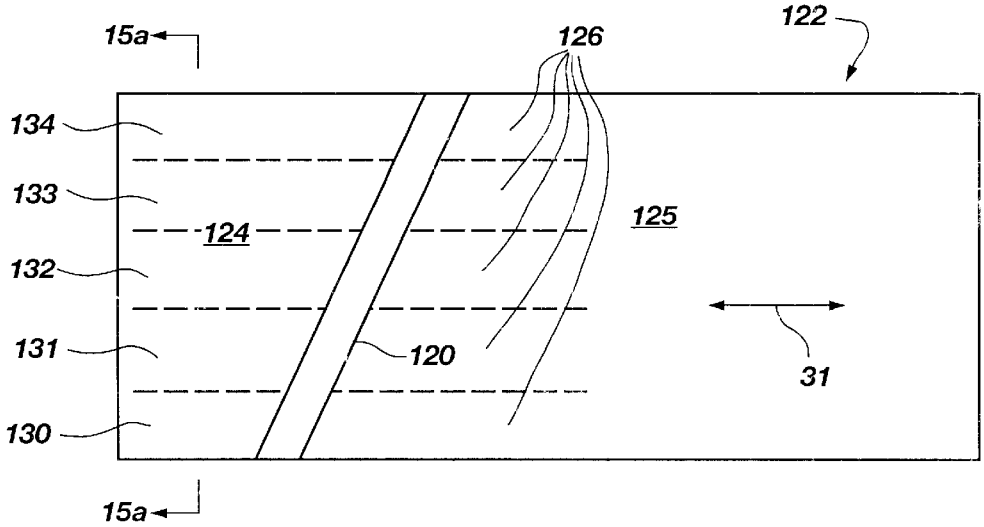
FIG. 15 is a top plan view of an electroacoustic transducer with a clamp member extending across the diaphragm at an acute angle relative to the longitudinal axis of the diaphragm.
Figure 15A:
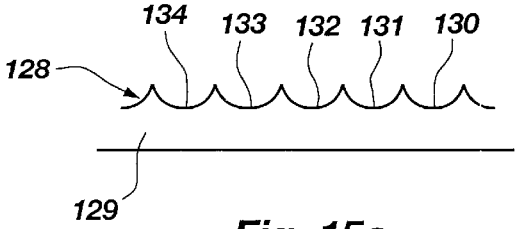
FIG. 15*a* represents a cross-section taken along lines 15*a* of FIG. 15.
Figure 16:
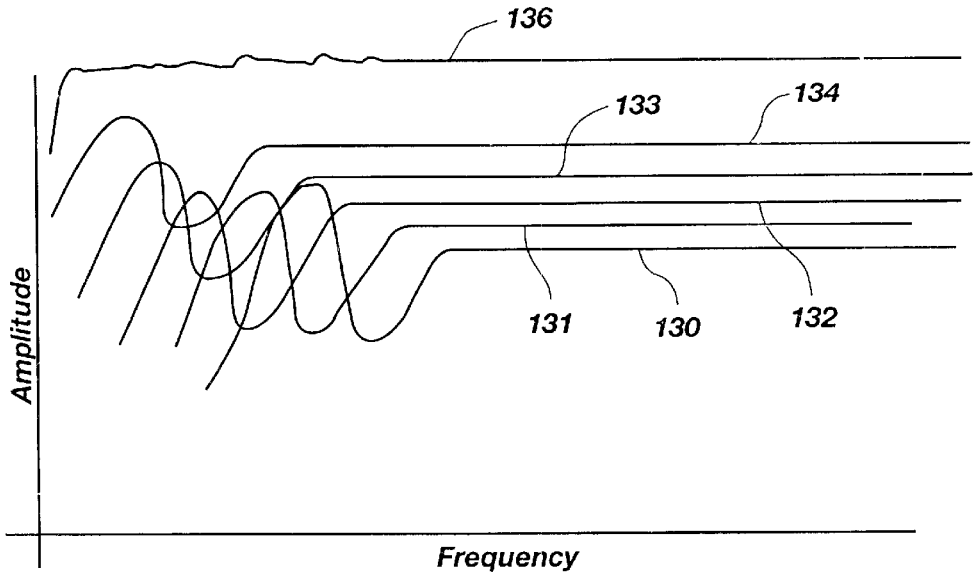
FIG. 16 is the frequency response graph of the diaphragm emitter sections shown in FIG. 15.

Referring now to FIG. 15, another preferred embodiment of the present invention is shown in which a clamp 120 is disposed on a diaphragm 122 at an acute angle with respect to the longitudinal direction of increased stiffness 31 of the diaphragm 122. This arrangement provides large emitter sections 124 and 125 which are trapezoidal rather than rectangular. Accordingly, sections 124 and 125 each support smaller multiple resonant frequencies corresponding to the length variations of the sections 130–134 in the longitudinal direction of increased stiffness. The resulting multiple resonances 130–134 synergistically combine, as shown in FIG. 16, to produce a combined signal 136 having a substantially enhanced frequency response, particularly in the lower frequencies. Similar multiple resonant frequencies are developed in the subsections 126 of section 125. FIG. 15*a* is an inverted rectified sine wave configuration 128, which shows another arrangement of numerous stiffening structures which may be supported on the stator 129.

Figure 17:
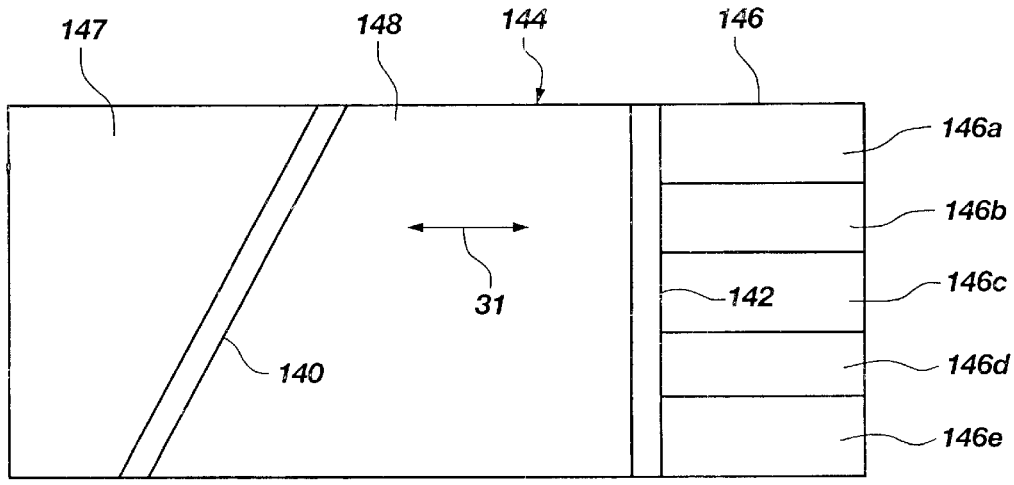
FIG. 17 is a top plan view of an electroacoustic transducer, showing one clamp member extending transversely across the diaphragm and another clamp member extending at an acute angle relative to the longitudinal axis of the diaphragm.

In FIG. 17, another preferred embodiment of this invention is shown, in which two clamps 140 and 142 are disposed at different locations and at different angles on a diaphragm 144. The clamps in the figure divide the diaphragm into three different sections 146, 147, and 148. Section 146 can be further subdivided into a number of equally sized regions 146*a–e* using clamps or stiffened regions. These subsections each produce the same resonant frequency. Using several equally sized regions allows each region to add to the overall sound produced by the group which enhances the sound output for that specific resonant frequency. By varying the number of clamps, as well as their location and angle, a wide variety of frequency responses may be obtained from the transducer.

The scope of the present invention, for all of the embodiments shown in FIGS. 10–17, includes the possible use of another stator opposing thestator.shown in each view, as illustrated in FIG. 1. Moreover, the clamps shown here may also have a second clamping member above the respective diaphragm to assist in securing the diaphragm. In addition, the diaphragm shown in each embodiment may be planar with stiffening means or non-planar, as shown in some of the embodiments above. The clamps may be secured to the diaphragms by contact and an additional securing means, such as adhesive. Finally, the transducermay have an electrostatic drive, as shown in FIG. 1, or it may be driven magnetically, as shown in FIGS. 18 and 19 described below.

Figure 18:
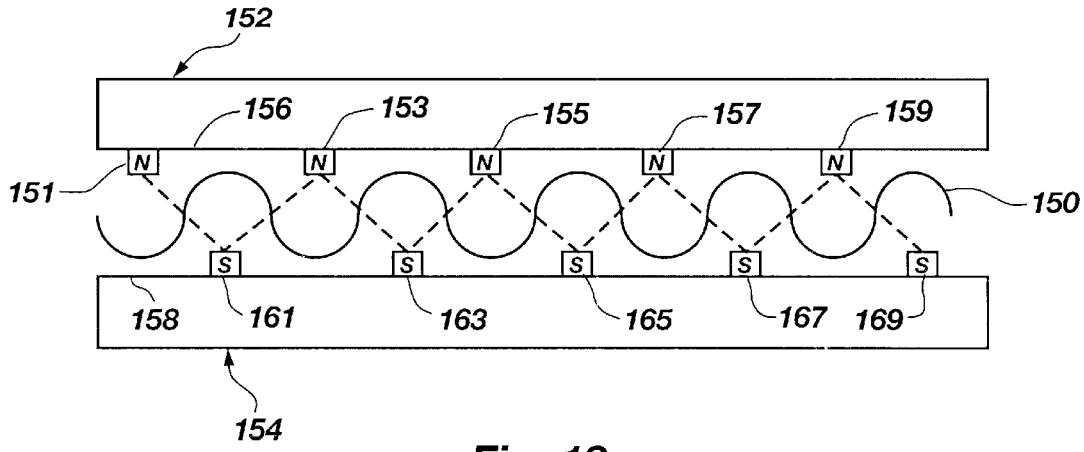
FIG. 18 is an electroacoustic transducer wherein magnets are employed for driving the diaphragm using cross-magnet polarity fields.

FIG. 18 shows a first magnetic embodiment, in which upper magnetic strips 151, 153, 155, 157 and 159 are attached to the inner surface 156 of an upper support member 152 and are magnetically oriented as north poles. Support members 152 and 154 only provide support and do not act as stators to drive the diaphragm 150. Rather, the acoustic drive signal is introduced across the magnetic strip elements, and the magnetic strips are employed as a magnetic drive.

Lower magnetic strips 161, 163, 165, 167, 169 are attached to the inner surface 158 of a lower support member 154 and are magnetically oriented as south poles. The lower magnetic strips are offset relative to the upper magnetic strips, so that the magnetic fields cut across at angles, as shown between the upper and lower poles at the angles shown by the dotted lines. This action tends to drive the diaphragm 150 at a 90 degree angle from the field lines. Because of the non-planar configuration of the diaphragm 150, it bends in the direction of the magnetic force to provide an acoustical response without significant distortion.

Figure 19:
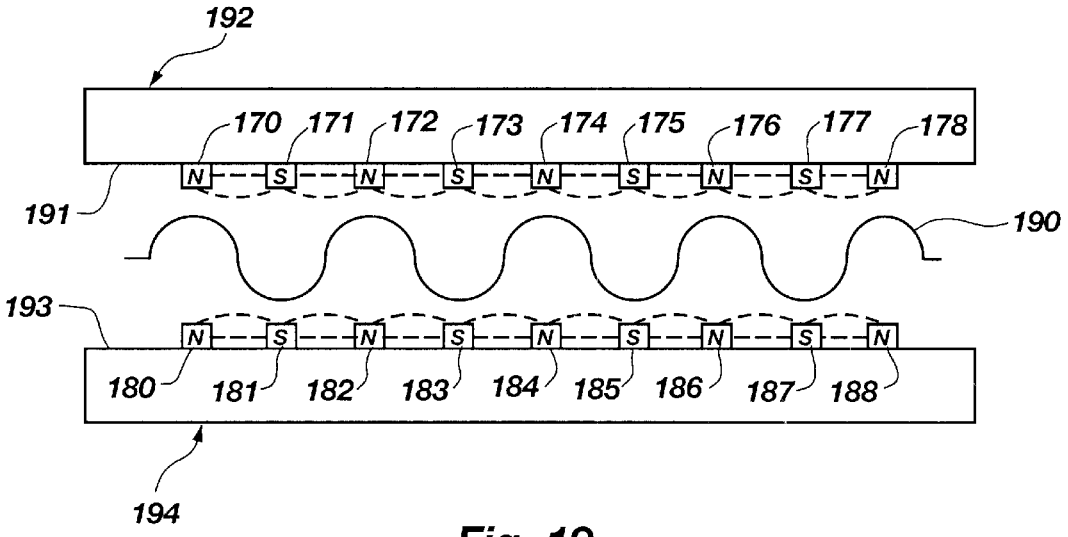
FIG. 19 is an electroacoustic transducer wherein magnets are employed for driving the diaphragm using planar magnetic fields.

Referring now to FIG. 19, an alternate magnetic embodiment of the present invention is shown in which a diaphragm 190 is suspended by one or more securing members (not shown) between opposing support members 192 and 194. Multiple magnetic strips 170–178 are attached to the inner surface 191 of the upper support member 192 and are longitudinally spaced across the cross-section of the upper support member 192. Likewise, multiple magnetic strips 180–188 are attached to the inner surface 193 of the lower member 194 and are longitudinally spaced across the cross-section of lower support member 194. The upper magnetic strips 170–178 are disposed directly across from the corresponding lower magnetic strips 180–188.

The upper magnetic strips 170–178 are alternately magnetized as north, south, north, south and north, respectively. Likewise, the opposing magnetic strips 180–188 have the same magnetic orientation of north, south, north, south and north, respectively. Consequently, the lines of the magnetic field flow in a planar fashion above and below the diaphragm 190, as shown. Since the lines of force compel movement of the diaphragm at 90 degrees to the field lines, the diaphragm 190 is driven in vertical oscillations, as desired.

Figure 20:
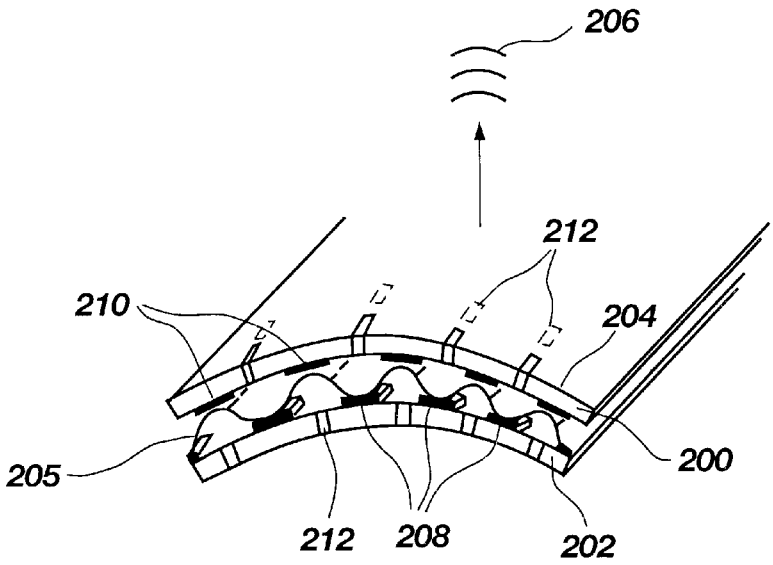
FIG. 20 is a concavo-convex embodiment of the electrostatic transducer.

Now a number curved embodiments of the present invention will be discussed. Referring now to FIG. 20, a version of the present invention with opposing stators 200 and 202 are respectively convex in shape with the same nesting configuration. This design includes an arc shape which provides a convex emitting face 204 to provide a diverging propagation of sound 206 through apertures 212 in the stators. This embodiment also uses segmented clamps 208 and a segmented cushion layer 210, which are both segmented in a noncontinuous manner. The clamp segments 208 hold the diaphragm 205 to the stator and provide stiffness in one direction. The cushion segments 210 are positioned for contact with contiguous peaks extending across the interior surface of at least one of the stators.

Figure 21:
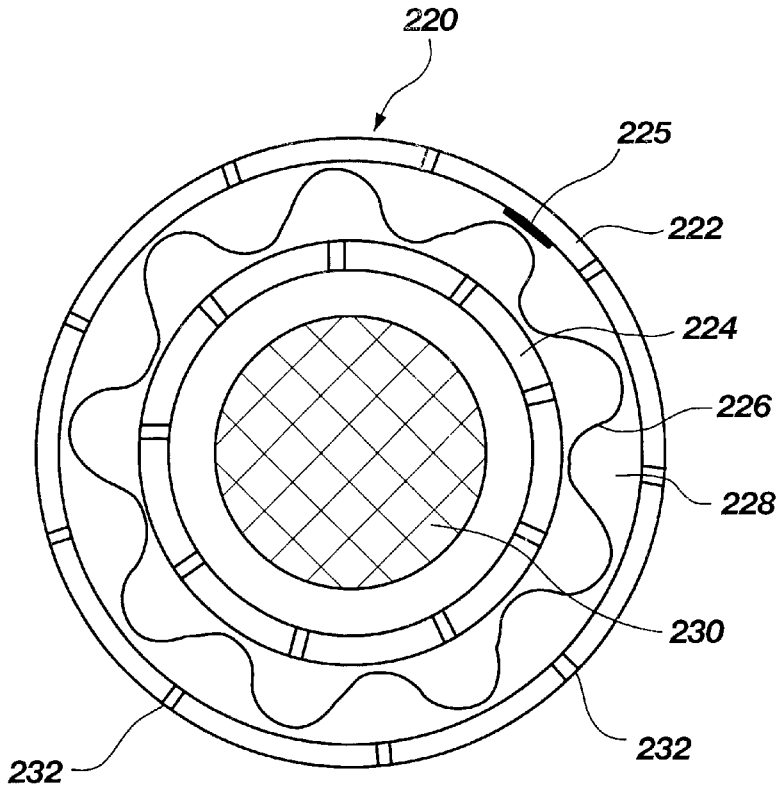
FIG. 21 is an electrostatic transducer with cocentric cylinder stators and a nonplanar diaphragm.

FIG. 21 depicts a cross section of an electrostatic transducer 220 where the respective first and second stators 222 and 224 are configured respectively as cylinders with concentric, enclosing geometries to provide an audio speaker having a substantially full surround emitting surface. The diaphragm 226 is suspended within the annular opening 228, being stabilized between the opposing interior surfaces of the stators. Cushioning members 225 may also be used, if desired, to cushion the diaphragm 226 and avoid contact with the stators which would produce interference.

Sound is emitted circumferentially, as well as vertically from a central resonant chamber 230. Openings 232 provide acoustic transparency along both radial orientations of propagation. A corrugated clamp, such as the one shown in FIG. 6, can also be attached in a circular configuration at the end of the cylinder to clamp the diaphragm in position. The diaphragm is illustrated in a preferred form with a general sinusoidal shape, but it should be recognized that other diaphragm configurations such as a rectified sinusoidal shape, or modified sawtooth shape could be used.

Figure 22:
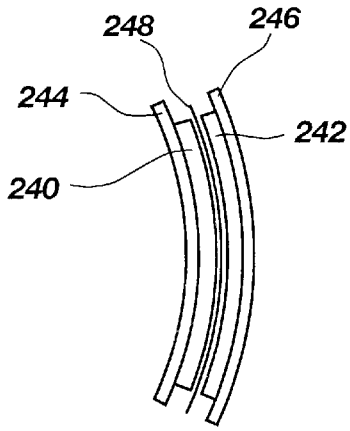
FIG. 22 is an end view of an electrostatic transducer with a diaphragm and stator in a curved configuration.

FIG. 22 is an end view of a curved configuration of stators and a diaphragm. The geometry of FIG. 22. includes two clamping members 240 and 242 and attached stators 244 and 246 are respectively concave and convex and in contact with opposing edges of the diaphragm 248. It is important to note that curved embodiments of this invention allow the diaphragms to be curved which is difficult to do in a conventional tensioned diaphragm system.

Figure 23:
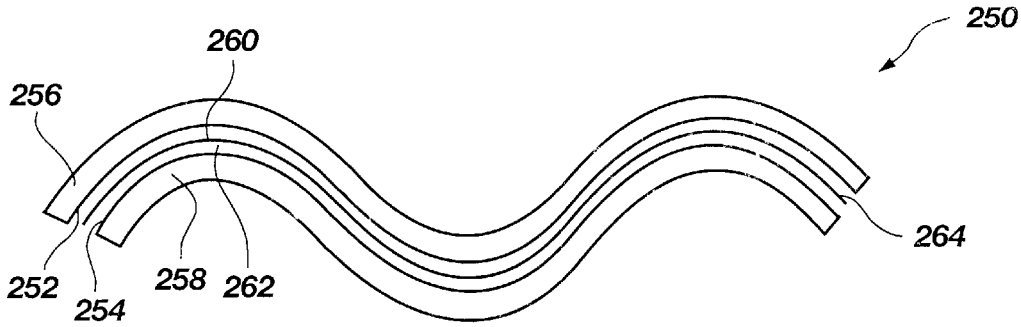
FIG. 23 is an electrostatic transducer with a sinusoidal stator and clamp configuration.

FIG. 23. shows an additional geometric embodiment of the electrostatic transducer 250, where the interior surfaces 252 and 254 of the first and second clamps 256 and 258 are geometrically configured to generally conform to the desired geometric configuration of the peaks 260 and the valleys 262 of the diaphragm 264. Corrugated electrostatic stators would also be used with clamps 256 and 258 to support the clamps in FIG. 23. This enables close positioning of the respective interior surfaces of the first and second stators (not shown) adjacent to the diaphragm. Openings are provided in the respective stators to facilitate acoustic transparency. It should be apparent based on this disclosure that other clamping geometries can be envisioned which place the stators in close position to the diaphragm to increase the effects of electrostatic field influence on the diaphragm.

Figure 24:
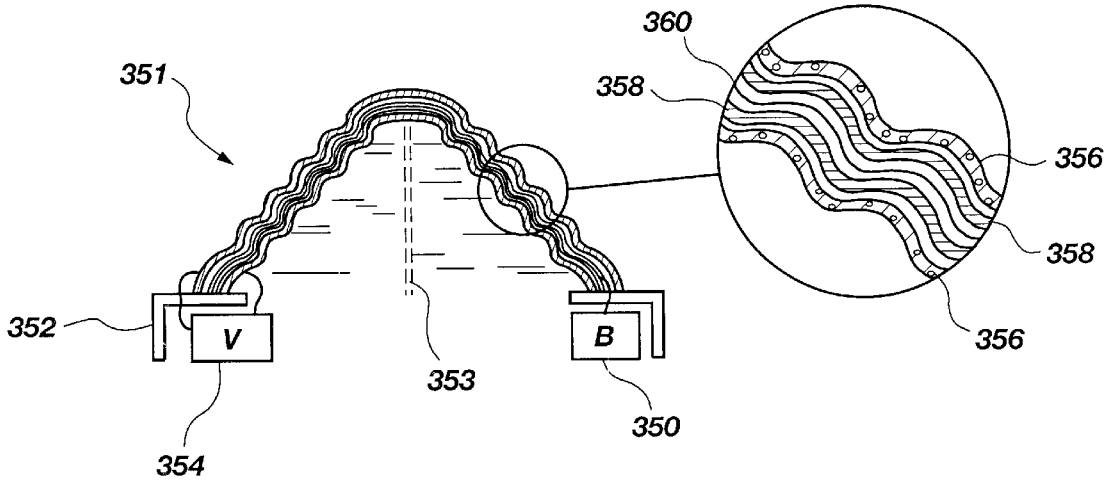
FIG. 24 is a cross-sectional side view of a hemispherical electrostatic speaker.

Another embodiment of an electrostatic transducer is shown in FIG. 24. A cross section view of a hemispherical electrostatic transducer 351 is shown anchored to a base 352. FIG. 24 is a cross section of the FIG. 25 along arrow 370. Two cylindrical corrugated stators 356 create a hemispherical shape and a non-planar diaphragm 360 is arranged between the two opposing stators. In addition, a supporting structure 353 runs along the inside surface of the hemisphere or along the longitudinal axis of the hemisphere. It should be realized that the stators have holes or apertures to make them acoustically transparent and allow ultrasonic waves to pass through. The diaphragm is biased by a bias voltage 350 and the audio signal voltage 354 is applied to produce an compression wave in the air. A cushioning or insulating layer 358 is contained within the stators so the diaphragm will not directly contact the conductive layer on the stators and avoids other distorting contact with the stator. It should also be apparent based on this disclosure, that frets may be included between the two stators 356 to divide the diaphragm 360 into a number of sections.

Figure 25:
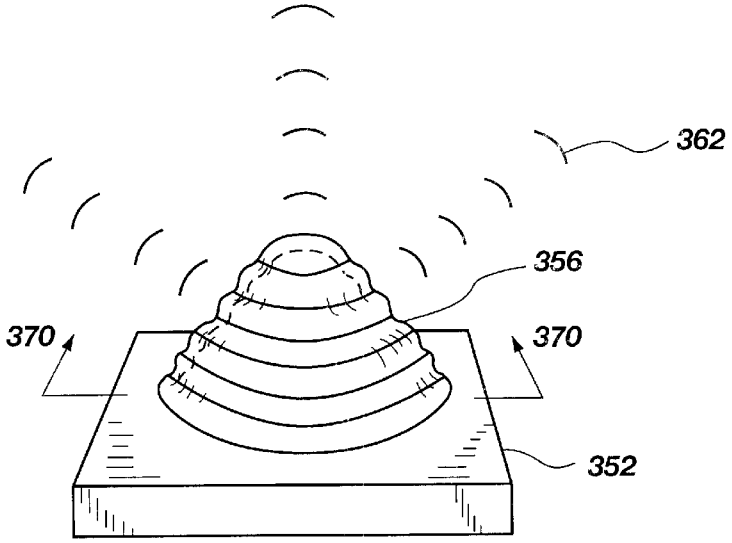
FIG. 25 is a perspective view of a hemispherical electrostatic speaker.
Figure 26:
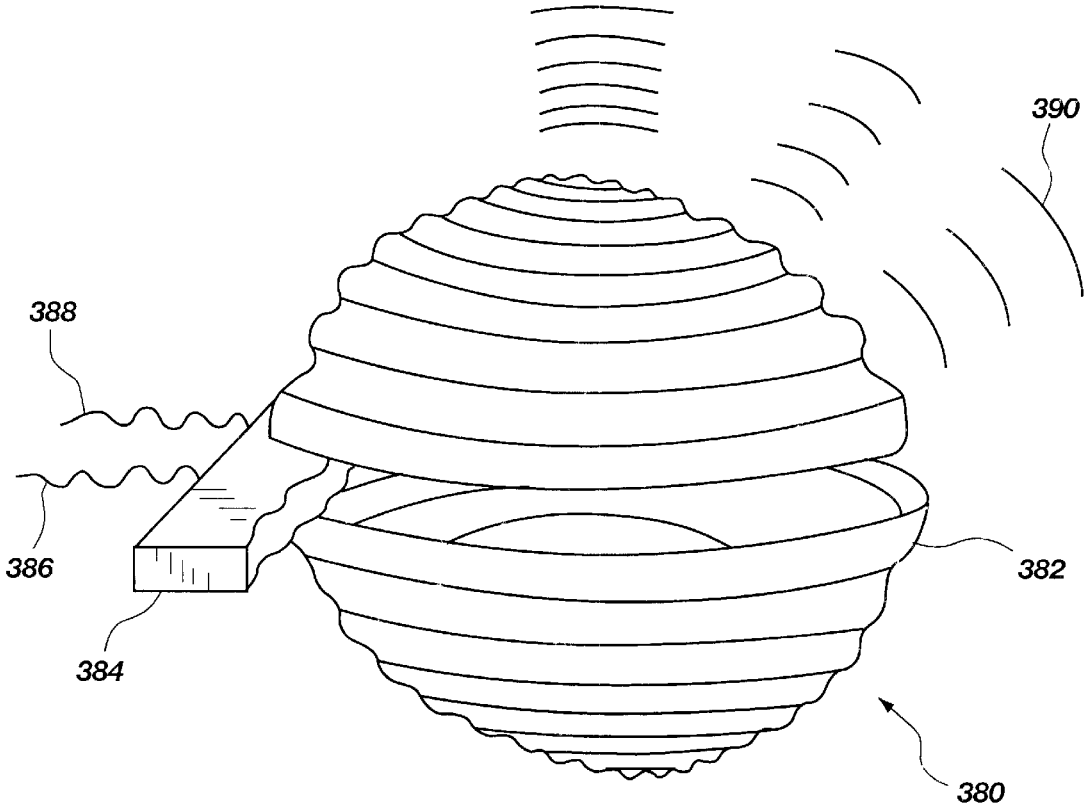
FIG. 26 is a perspective side view of a spherical electrostatic speaker.

FIG. 25 is a perspective view of a hemispherical electrostatic speaker. Because of the hemispherical nature of this embodiment, the sound that emanates through the stators 356 radiates in 180 degrees in multiple axes. A full sphere embodiment of the present embodiment is shown in FIG. 26. This figure shows a partially exploded view of the spherical embodiment 380 which might be a combination of two hemispheres shown in FIG. 25. This spherical arrangement allows the sound waves 390 to be generated in all possible directions. An electrical assembly 384 (shown cut away) can be the base for the two hemispheres. The electrical assembly can also be sized small enough to be contained within the hemispheres, if desired. A bias is applied to the diaphragms contained within the hemispheres through the bias input 388 and the audio signal is then applied through 386.

It will be apparent to those skilled in the art that numerous variations can be applied with respect to the numerous inventive concepts set forth above. Such variations are intended to fall within the scope of the invention as disclosed herein and as claimed hereafter.

We claim:

1. An electroacoustic transducer, including:

at least one stator member having an operating surface for positioning adjacent an emitter diaphragm;

an emitter diaphragm suspended adjacent to and spaced a sufficient distance from the operating surface of the stator member to enable diaphragm oscillation in response to an applied signal voltage to permit diaphragm movement within at least one emitter section without contacting the operating surface of the stator member;

said diaphragm being configured with alternating peaks and valleys extending along a longitudinal dimension of the diaphragm, including an increased stiffness orientation which provides greater directional stiffness along the longitudinal dimension, wherein the alternating a securing structure applied in transverse orientation with respect to the stiffness orientation at the diaphragm with respect to the operating surface of the stator member to secure the diaphragm in a fixed position.

2. The electroacoustic transducer of claim 1, wherein the securing structure is a single elongated member having an outer surface in contact with the stator member and an inner surface secured to the diaphragm.

3. The electroacoustic transducer of claim 2, wherein the inner surface of the elongated member is secured to the diaphragm by adhesive.

4. The electroacoustic transducer of claim 2, wherein the inner surface of the elongated member conforms to the shape of the diaphragm.

5. The electroacoustic transducer of claim 1, wherein the securing structure is a pair of elongated members on opposite sides of the diaphragm, each elongated member having an outer surface in contact with the stator member and an inner surface secured to the diaphragm.

6. The electroacoustic transducer of claim 5, wherein the inner surface of at least one of the elongated members is secured to the diaphragm by adhesive.

7. The electroacoustic transducer of claim 5, wherein the inner surface of at least one of the pair of elongated members conforms to the shape of the diaphragm.

8. The electroacoustic transducer of claim 5, wherein the diaphragm is a non-planar structure and the inner surfaces of the pair of elongated members are substantially planar and are disposed substantially adjacent to each other with the diaphragm in between, thereby deforming the non-planar structure of the diaphragm at the point of contact of the elongated members.

9. The electroacoustic transducer of claim 1, wherein the increased stiffness orientation of the diaphragm is provided by the diaphragm having a substantially non-planar cross-section along the diaphragm in the direction of increased stiffness of the diaphragm, thereby providing support to enable the diaphragm to oscillate in the absence of tension in the direction of stiffness.

10. The electroacoustic transducer of claim 9, wherein nonplanar cross-section of the diaphragm is configured with multiple peaks and valleys along the cross-section.

11. The electroacoustic transducer of claim 9, wherein the nonplanar cross-section of the diaphragm is configured to approximate a sine wave.

12. The electroacoustic transducer of claim 9, wherein the nonplanar cross-section of the diaphragm is configured to approximate a rectified sine wave.

13. The electroacoustic transducer of claim 9, wherein the nonplanar cross-section of the diaphragm is configured with at least one added thickness to the diaphragm, running, in the direction of increased stiffness.

14. The electroacoustic transducer of claim 9, wherein the nonplanar cross-section of the diaphragm is configured with a varied composition of reduced flexibility in strips on the diaphragm, running in the direction of increased stiffness.

15. The electroacoustic transducer of claim 1, wherein the securing structure comprises at least one elongated clamp member extending across the diaphragm at an intermediate position with respect to the direction of increased stiffness of the diaphragm, to form at least two of said emitter sections.

16. The electroacoustic transducer of claim 15, wherein the elongated clamp member extends across the diaphragm to divide the diaphragm into at least two of said emitter sections of different sizes.

17. The electroacoustic transducer of claim 15, wherein at least one elongated clamp member extends substantially normal to the direction of increased stiffness of the diaphragm.

18. The electroacoustic transducer of claim 15, wherein at least one elongated clamp member extends at an acute angle to the direction of increased stiffness of the diaphragm to form at least one emitter section having multiple resonant frequencies.

19. The electroacoustic transducer of claim 1, wherein the at least one stator member comprises opposing stators disposed substantially parallel to the diaphragm on opposite sides thereof.

20. The electroacoustic transducer of claim 19, wherein the opposing stators and diaphragm include means for the signal voltage to be applied across the opposing stators and for a voltage bias to be applied to the diaphragm to enable the diaphragm to acoustically oscillate.

21. The electroacoustic transducer of claim 20, wherein the opposing stators and diaphragm include means for the signal voltage to be applied electrostatically to the opposing stators.

22. The electroacoustic transducer of claim 20, wherein the opposing stators and diaphragm include means for the signal voltage to be applied magnetically to the opposing stators.

23. The electroacoustic transducer of claim 1, wherein the diaphragm operably oscillates in the absence of tension applied along the direction of stiffness.

24. The electroacoustic transducer of claim 1, wherein the diaphragm operably oscillates with tension applied along the direction of stiffness.

25. The electroacoustic transducer of claim 1 further comprising a plurality of equally spaced clamps arranged to create diaphragm regions each having an equivalent resonant frequency to boost the sound output at that frequency.

26. The electroacoustic transducer of claim 1 wherein the securing structure is nonplanar.

27. An electroacoustic transducer, including:

opposing stators substantially parallel to each other, each stator having an operating surface facing the operating surface of the opposing stator;

an emitter diaphragm suspended between the opposing stators and spaced a sufficient distance from the operating surfaces of the stators to enable diaphragm oscillation in an emitter section of the diaphragm in response to an applied signal voltage without contacting the operating surfaces of the stators.

the diaphragm being configured with alternating peaks and valleys extending along a longitudinal dimension of the diaphragm, including an increased stiffness orientation which provides greater directional stiffness along the longitudinal dimension, wherein the alternating peaks and valleys produce acoustic output; and a securing structure positioned between the diaphragm and the operating surface of each stator to secure the diaphragm in a fixed position relative to the stator.

28. The electroacoustic transducer of claim 27, wherein the diaphragm is configured with a non-planar cross-section to provide directional stiffness along the diaphragm.

29. The electroacoustic transducer of claim 27, wherein the securing structure comprises a clamp member clamping the diaphragm and extending across the direction of increased stiffness of the diaphragm.

30. The electroacoustic transducer of claim 27, wherein the clamp member extends at an acute angle to the direction of increased stiffness of the diaphragm to form at least one emitter section having multiple resonant frequencies.

31. A method for generating audio output from an electroacoustic transducer, comprising the steps of:

positioning at least one stator member having an operating surface adjacent an emitter diaphragm;

suspending an emitter diaphragm adjacent to and spaced a sufficient distance from the operating surface of the stator member to enable diaphragm oscillation in an emitter section of the diaphragm in response to an applied signal voltage without contacting the operating surface of the stator member;

configuring the diaphragm with alternating peaks and valleys, including at least one increased stiffness orientation which provides greater directional stiffness along a longitudinal direction of the diaphragm and within the emitter section to enable the emitter diaphragm to operably oscillate in the absence of tension applied along the stiffness orientation; and positioning a securing structure between the diaphragm and the operating surface of the stator member to secure the diaphragm in a fixed position relative to the stator.

32. The method for generating audio output from an electroacoustic transducer of claim 31, wherein the step of positioning the securing structure comprises positioning an elongated member having an outer surface in contact with the stator member and an inner surface secured to the diaphragm.

33. The method for generating audio output from an electroacoustic transducer of claim 31 wherein the positioning step comprises positioning an elongated member having an inner surface conforming to the shape of the diaphragm.

34. The method for generating audio output from an electroacoustic transducer of claim 31 wherein the positioning step comprises positioning a pair of elongated members on opposite sides of the diaphragm, each elongated member having an outer surface in contact with the stator member and an inner surface secured to the diaphragm.

35. The method for generating audio output from an electroacoustic transducer of claim 34, and further configuring the inner surface of at least one of the pair of elongated members to conform to the shape of the diaphragm.

36. The method for generating audio output from an electroacoustic transducer of claim 34, and further configuring the inner surfaces of the pair of elongated members to be substantially planar and disposing the pair of elongated members substantially adjacent to each other with a nonplanar diaphragm in between, thereby deforming the non-planar diaphragm at a point of contact with the pair of elongated members.

37. The method for generating audio output from an electroacoustic transducer of claim 31, wherein the diaphragm is configured with a substantially non-planar cross-section along the diaphragm in the direction of increased stiffness of the diaphragm, thereby providing support to enable the diaphragm to oscillate in the absence of tension in the direction of stiffness.

38. The method for generating audio output from an electroacoustic transducer of claim 37, wherein the nonplanar cross-section of the diaphragm is configured with multiple peaks and valleys along the cross-section.

39. The method for generating audio output from an electroacoustic transducer of claim 31, wherein the nonplanar cross-section of the diaphragm is configured with at least one added thickness to the diaphragm, running in the direction of increased stiffness.

40. The method for generating audio output from an electroacoustic transducer of claim 31, wherein the nonplanar cross-section of the diaphragm is configured with a varied composition of reduced flexibility in strips, on the diaphragm, running in the direction of increased stiffness.

41. The method for generating audio output from an electroacoustic transducer of claim 31, wherein the step of positioning the securing structure comprises positioning at least one elongated clamp member to extend across the diaphragm at an intermediate position with respect to the direction of increased stiffness of the diaphragm, to form at least two said emitter sections.

42. The method for generating audio output from an electroacoustic transducer of claim 41, wherein the positioning step comprises positioning the elongated clamp member to extend perpendicular across the direction of increased stiffness of the diaphragm to divide the diaphragm into at least two said emitter sections of different sizes.

43. The method for generating audio output from an electroacoustic transducer of claim 41, wherein the positioning step comprises positioning at least one elongated clamp member to extend substantially transverse to the direction of increased stiffness of the diaphragm.

44. The method for generating audio output from an electroacoustic transducer of claim 41, wherein the positioning step comprises positioning at least one elongated clamp member to extend at an acute angle to the direction of increased stiffness of the diaphragm to form at least one emitter section having multiple resonant frequencies.

45. A method for generating audio output from an electroacoustic transducer, comprising the steps of:

disposing opposing stators substantially parallel to each other, each stator having an operating surface facing the operating surface of the opposing stator;

suspending an emitter diaphragm between the opposing stators spaced a sufficient distance from the operating surfaces of the stators to enable diaphragm oscillation in an emitter section of the diaphragm in response to an applied signal voltage without contacting the operating surfaces of the stators, configuring the diaphragm with alternating peaks and valleys extending along a longitudinal dimension of the diaphragm, including an increased stiffness orientation which provides greater directional stiffness along the longitudinal dimension, wherein the alternating peaks and valleys produce acoustic output; and positioning a securing structure between the diaphragm and the operating surface of the stators to secure the diaphragm in a fixed position relative to the stators. the diaphragm with an orientation which provides a primary directional stiffness along the diaphragm and within the emitter section to enable the emitter diaphragm to operably oscillate in the absence of tension applied along the stiffness orientation; and positioning a securing structure be(teen the diaphragm and the operating surface of the stators to secure the diaphragm in a fixed position relative to the stators.

46. The method for generating audio output from an electroacoustic transducer of claim 45, and further comprising configuring the diaphragm with a non-planar cross-section to provide directional stiffness along the diaphragm.

47. The method for generating audio output from an electroacoustic transducer of claim 46, wherein the securing step comprises clamping the diaphragm with a clamp member extending across the direction of increased stiffness of the diaphragm.

48. The method for generating audio output from an electroacoustic transducer of claim 47, wherein the clamping step comprises positioning at least one clamp member to extend at an acute angle to the direction of increased stiffness of the diaphragm to form at least one emitter section having multiple resonant frequencies.

49. An electrostatic transducer, comprising:

at least one corrugated stator member having an operating surface for positioning adjacent an emitter diaphragm;

an emitter diaphragm suspended adjacent to and spaced a sufficient distance from the operating surface of the stator member to enable diaphragm oscillation in response to an applied signal voltage and to permit diaphragm movement within at least one emitter section without contacting the operating surface of the stator member; and said diaphragm being configured with at least one increased stiffness orientation which provides greater directional stiffness along a longitudinal dimension of the diaphragm and within the emitter section to enable the emitter diaphragm to operably oscillate at a desired resonant frequency.

50. The electrostatic transducer as in claim 49 further comprising at least one securing structure applied in transverse orientation with respect to the stiffness orientation at the diaphragm and the operating surface of the corrugated stator member to secure the diaphragm in a fixed position.

51. The electrostatic transducer as in claim 50 wherein the diaphragm is corrugated.

52. The electrostatic transducer as in claim 51 wherein the emitter diaphragm is substantially equidistantly spaced from directly adjacent points on the at least one corrugated stator member and secured in position by the securing structure.

53. The electrostatic transducer as in claim 51 further comprising at least two securing structures for securing the diaphragm, equidistantly from directly adjacent points on the at least one corrugated stator member between two securing structures.

54. The electrostatic transducer as in claim 51 further comprising at least three securing structures wherein a first substantially equidistant space exists from points on the diaphragm to directly adjacent points on the at least one corrugated stator member between a first and second securing structures, and a second substantially equidistant space exists from points on the diaphragm to directly adjacent points on the at least one corrugated stator member between a second and third securing structures.

55. The electrostatic transducer as in claim 50 wherein the at least one securing structure extends at an acute angle to the direction of increased stiffness of the diaphragm to form at least one emitter section having multiple resonant frequencies.

56. An electrostatic transducer, comprising:

opposing corrugated stators substantially parallel to each other, each stator having an operating surface facing the operating surface of an opposing stator;

an emitter diaphragm suspended between the opposing stators and spaced a sufficient distance from the operating surfaces of the stators to enable diaphragm oscillation in an emitter section of the diaphragm in response to an applied signal voltage without contacting the operating surfaces of the stators; and wherein the diaphragm is configured with an orientation which provides greater directional stiffness along a longitudinal direction of the diaphragm and within the emitter section to enable the emitter diaphragm to operably oscillate in the absence of tension applied along the stiffness orientation.

57. The electrostatic transducer as in claim 56 further comprising at least one securing structure positioned between the diaphragm and the operating surface of each corrugated stator to secure the diaphragm in a fixed position relative to the corrugated stators.

58. The electrostatic transducer as in claim 57 wherein the securing structure is corrugated.

59. The electrostatic transducer as in claim 58 wherein the emitter diaphragm is equidistantly spaced from directly adjacent points on the opposing corrugated stators and secured in position by the securing structure.

60. The electrostatic transducer as in claim 56 wherein the diaphragm is closely positioned to the opposing corrugated stators to increase the effects of electrostatic field effects on the diaphragm.

61. The electrostatic transducer as in claim 56 further comprising openings in the opposing corrugated stators to provide acoustic transparency.

62. The electrostatic transducer as in claim 56 wherein the diaphragm is corrugated.

63. The electrostatic transducer as in claim 56 wherein the corrugated stators form a substantially curved shape.

64. The electrostatic transducer as in claim 56 wherein the corrugated stators form a substantially hemispherical shape.

65. The electrostatic transducer as in claim 56 wherein the corrugated stators form a substantially spherical shape.

66. The electrostatic transducer as in claim 56 wherein the corrugated stators form a substantially cylindrical shape.

67. The electrostatic transducer as in claim 58 further comprising at least two securing structures for securing the diaphragm equidistantly from directly adjacent points on the at least one corrugated stator member between two securing structures.

68. The electrostatic transducer as in claim 58 further comprising at least three securing structures wherein a first substantially equidistant space exists from points on the diaphragm to directly adjacent points on the at least one corrugated stator member between a first and second securing structures, and a second substantially equidistant space exists from points on the diaphragm to directly adjacent points on the at least one corrugated stator member between a second and third securing structures.

69. The electrostatic transducer as in claim 57 wherein the at least one securing structure extends at an acute angle to the direction of increased stiffness of the diaphragm to form at least one emitter section having multiple resonant frequencies.

70. An electroacoustic transducer, including:

at least one stator member having an operating surface for positioning adjacent an emitter diaphragm;

an emitter diaphragm suspended adjacent to and spaced a sufficient distance from the operating surface of the stator member to enable diaphragm oscillation in response to an applied signal voltage to permit diaphragm movement within at least one emitter section without contacting the operating surface of the stator member;

said diaphragm being configured with alternating peaks and valleys extending along a longitudinal dimension of the diaphragm, including an increased stiffness orientation which provides greater directional stiffness along the longitudinal direction, wherein the alternating peaks and valleys produce acoustic output; and a securing structure, applied in transverse orientation with respect to the stiffness orientation at the diaphragm, having a diaphragm contacting portion which has a substantially non-planar configuration that corresponds to the alternating peaks and valleys of the diaphragm, to secure the diaphragm in a fixed position.

* * * * *